United States Patent [19]

Richter

[11] Patent Number: 4,603,441

[45] Date of Patent: Aug. 5, 1986

[54] SPORT GARMENT FOR WOMEN

[76] Inventor: Lois M. Richter, 69 W. Brother Dr., Greenwich, Conn. 06830

[21] Appl. No.: 761,862

[22] Filed: Aug. 2, 1985

[51] Int. Cl.[4] ..... A41D 1/14

[52] U.S. Cl. ..... 2/211; 2/48; 2/227; 224/226

[58] Field of Search ..... 2/211, 212, 213, 247, 2/250, 48; 224/919, 226, 227

[56] References Cited

U.S. PATENT DOCUMENTS

| | | | |
|---|---|---|---|
| 2,568,421 | 9/1951 | Van Staagen | 2/48 |
| 2,592,087 | 4/1952 | Wallace | 224/226 |
| 3,231,898 | 2/1966 | Yablon | 2/48 |
| 4,079,871 | 3/1978 | Sica | 2/247 X |
| 4,446,574 | 5/1984 | Kalomeris | 2/247 X |
| 4,545,079 | 10/1985 | Bakker | 2/48 |

FOREIGN PATENT DOCUMENTS

| | | | |
|---|---|---|---|
| 180215 | 10/1935 | Switzerland | 224/226 |

*Primary Examiner*—Werner H. Schroeder
*Assistant Examiner*—J. L. Olds
*Attorney, Agent, or Firm*—Charles E. Baxley

[57] ABSTRACT

A sport garment for women has an outer side and an inner side and comprises a fabric piece having a maximum dimension perpendicular to a centerline, an upper edge extending both ways therefrom from a first garment end to a second garment end, a lower edge including a curved central portion defining a central garment portion symmetrical with respect to the centerline and having a center of curvature above the lower edge and first and second end portions extending from the central portion to the first and second garment ends and defining first and second garment end portions, respectively, first and second pockets, each sized to receive a plurality of tennis balls, on the central portion on the outer side of the garment and symmetrical with respect to the centerline. Each pocket has an opening facing the upper edge. The garment end portions are releasably joinable about a wearer's waist with the inner side confronting the wearer's body. The garment may be worn with the central portion on that hip of the wearer selected by the wearer so that one of the pockets is on the front of the wearer's body and accessible to the hand of the wearer selected by the wearer.

11 Claims, 5 Drawing Figures

SPORT GARMENT FOR WOMEN

BACKGROUND OF THE INVENTION

This invention relates to sport garments for women and more particularly to such a garment for tennis.

In tennis, a player commonly holds, or attempts to hold, a plurality of tennis balls while a point is being played. Because women's hands are smaller than men's hands, it is generally more difficult for a woman to hold a plurality of tennis balls than it is for a man so to do.

It is an important object of the present invention to provide a garment, to be fastened around the waist, having a pocket which can hold as many as three readily available tennis balls.

It is another object to provide such a garment which holds the tennis balls in such a way as not to interfere with the player's game.

It is an additional object to provide a single such garment which will fit a wide range of waist sizes.

It is a further object to provide such a garment having two such pockets, so that the garment can be worn with a pocket accessible to either the player's right hand or left hand, at the player's option.

It is a still further object to provide such a garment having an auxiliary pocket for holding money, credit cards, keys, etc.

It is yet an additional object to provide such a garment having towel holding means.

It is yet a further object to provide such a garment which is securable about a player's waist by tying or otherwise.

It is also an object to provide such a garment which is inexpensive and attractive.

Additional objects and advantages will appear hereinafter.

SUMMARY OF THE INVENTION

A garment in accordance with the invention has an outer side and an inner side and comprises a fabric piece having a maximum dimension perpendicular to a centerline, an upper edge extending both ways therefrom from a first garment end to a second garment end, a lower edge including a curved central portion defining a central garment portion symmetrical with respect to the centerline and having a center of curvature above the lower edge and first and second end portions extending from the central portion to the first and second garment ends and defining first and second garment end portions, respectively, first and second pockets, each sized to receive a plurality of tennis balls, on the central portion on the outer side of the garment and symmetrical with respect to the centerline. Each pocket has an opening facing the upper edge. The garment end portions are releasably joinable about a wearer's waist with the inner side confronting the wearer's body. The garment may be worn with the central portion on that hip of the wearer selected by the wearer so that one of the pockets is on the front of the wearer's body and accessible to the hand of the wearer selected by wearer.

DESCRIPTION OF THE INVENTION

The invention will be first described with reference to FIGS. 1 and 2 which illustrate a garment 6 in flat condition.

Figure 1:
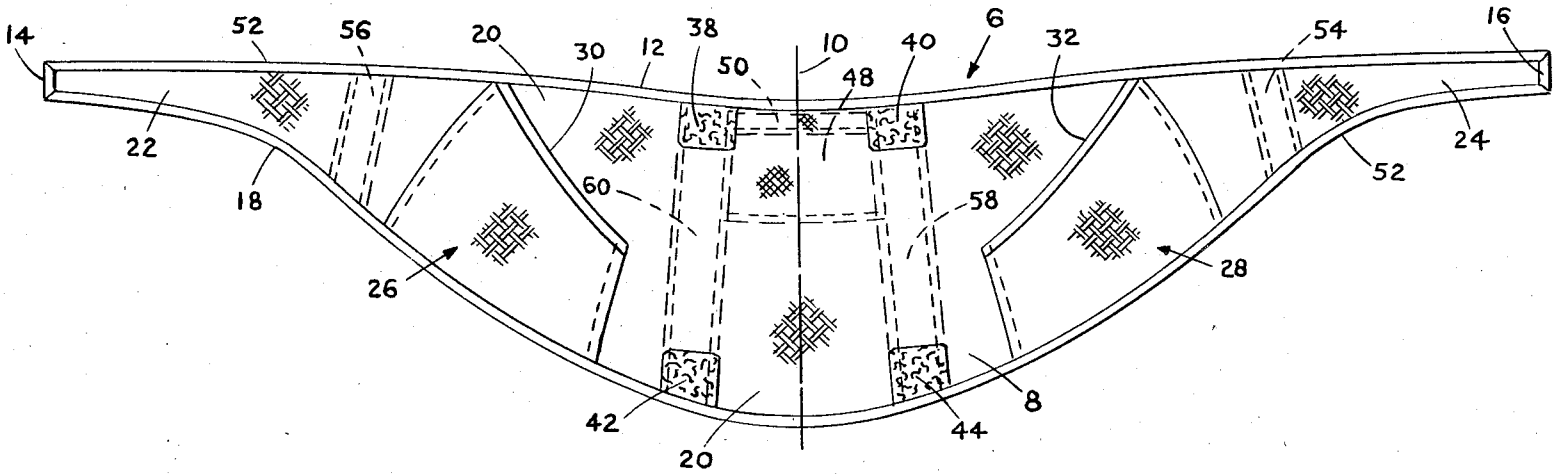
FIG. 1 is a flat view of the outer side of a preferred garment embodying the invention.
Figure 2:
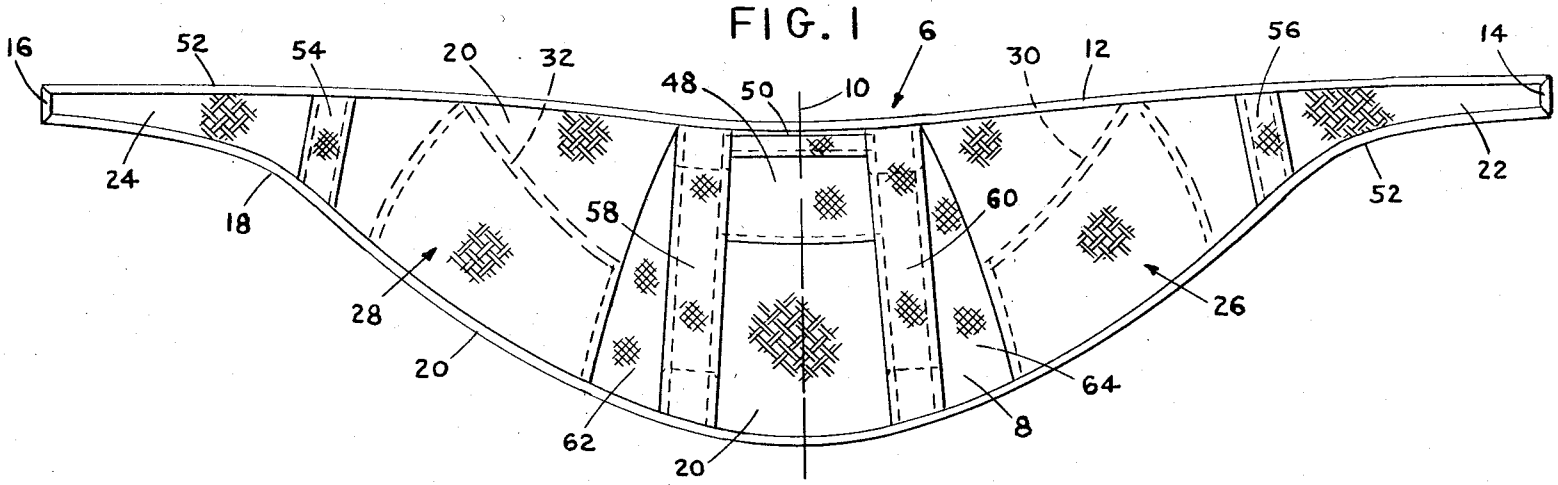
FIG. 2 is a flat view of the inner side of the garment of FIG. 1.

Garment 6 has an outer side which is shown in FIG. 1 and an inner side which is shown in FIG. 2. Garment 6 comprises a fabric piece 8 having a maximum dimension perpendicular to a centerline 10, an upper edge 12 extending both ways from centerline 10 from a first end 14 of garment 6 to a second end 16 of garment 6, a lower edge 18 including a curved central portion defining a central portion 20 of garment 6 which is symmetrical with respect to centerline 10 and having a center of curvature above lower edge 18.

Lower edge 18 further has first and second end portions extending from central portion 20 to first and second ends 14 and 16 of garment 6, respectively, and defining first and second garment end portions 22 and 24 respectively.

Garment 6 further has first and second pockets 26 and 28, respectively, on central portion 20 of garment 6, on the outer side of garment 6. Pockets 26 and 28 are symmetrical with respect to and spaced from centerline 10. Pockets 26 and 28 are mirror images of each other. Pocket 26 has an opening 30 generally facing upper edge 12 and oriented diagonally upward from the end thereof adjacent centerline 10 to the end thereof remote from centerline 10. Pocket 28 has an opening 32 generally facing upper edge 12 and oriented diagonally upward from the end thereof adjacent centerline 10 to the end thereof remote from centerline 10.

Garment end portions 22 and 24 are releasably joinable to each other by tying about a wearer's waist with the inner side of garment 6 confronting the wearer's body, and central portion 20 on that hip of the wearer selected by the wearer and with one of pockets 26 and 28 on the front of the wearer's body and accessible to the hand of the wearer selected by the wearer. More particularly, if the wearer is righthanded, she will normally want to have pocket 26 accessible to her left hand, so she will tie garment 6 on with central garment portion 20 on her left hip and garment end portions 22 and 24 on her right hip, thus rendering pocket 26 accessible to her left hand. If the wearer is lefthanded, she will want to have pocket 28 accessible to her right hand, so she will tie garment 6 on with central garment portion 20 on her right hip and garment end portions 22 and 24 on her left hip, thus rendering pocket 28 accessible to her right hand.

Piece 8 and pockets 26 and 28 are of open mesh material with give, and pockets 26 and 28 are of sufficient size that each can contain a plurality of tennis balls, preferably as many as three.

The ends of pocket openings 30 and 32 remote from centerline 10 are at upper edge 12 and the ends of openings 30 and 32 adjacent centerline 10 are spaced from upper edge 12 and from lower edge 18.

Figure 4:
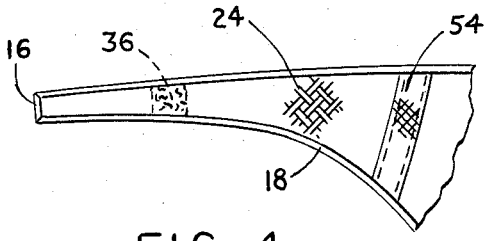
FIG. 4 is a fragmentary view of a portion of the interior of a modified garment embodying the invention.
Figure 5:
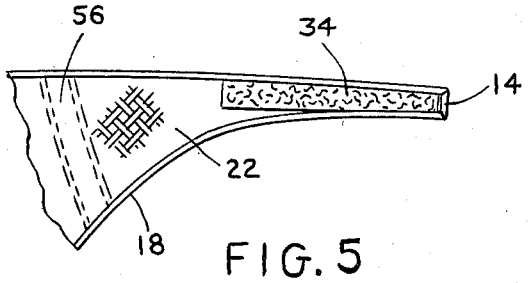
FIG. 5 is a fragmentary view of a portion of the exterior of the modified garment of FIG. 4.

FIGS. 4 and 5 illustrate a variant in which, instead of tying garment end portions 22 and 24 together, end portions 22 and 24 are releasably joinable together by interengagement of a pile pad 34, of a hook and pile type fastener (for example a VELCRO fastener), on the outside surface of garment end portion 22 (FIG. 5) and a matable hook pad 36 on the inside surface of garment end portion 24 (FIG. 4). To accommodate differing waist sizes, one of pads 34 and 36 may be elongated. As shown, pad 34 is elongated.

Figure 3:
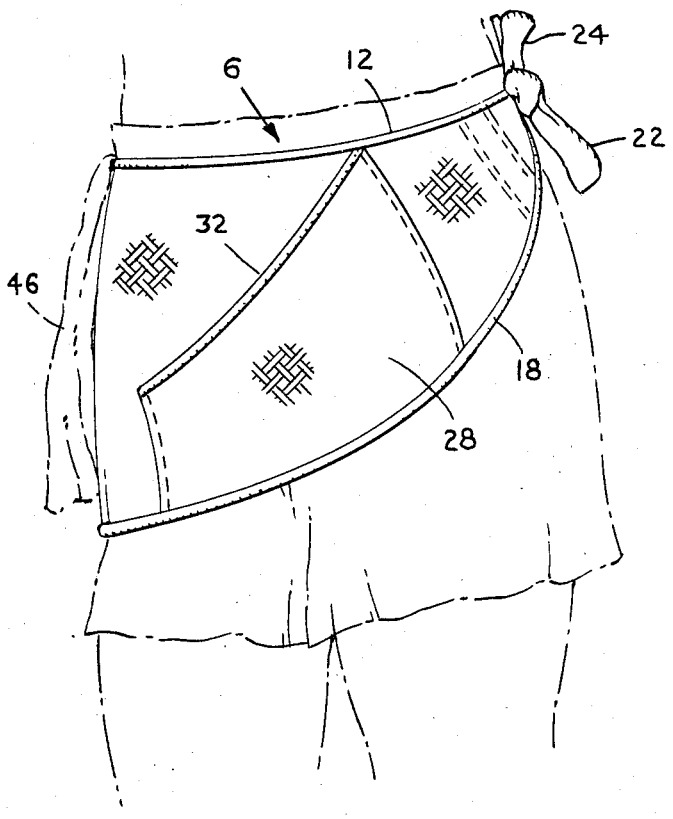
FIG. 3 is a view showing the garment of FIGS. 1 and 2 being worn around a player's waist, the player being shown from the front, such that a pocket of the garment is accessible to the player's right hand, and further showing a towel detachably carried by the garment.

Garment 6 may also be provided with matable hook and pile pads 38, 40, 42 and 44 on the outer side of garment 6, near centerline 10 for releasably holding a towel 46 (FIG. 3).

Garment 6 may also be provided with an auxiliary pocket 48 on the inner side of garment 6 and between straps 58 and 60, pocket 48 having an upwardly facing opening 50 (FIG. 2) traversing centerline 10 for holding money, credit cards, keys or the like. Opening 50 is located along upper edge 12 and has a hook and pile closure (not shown).

Garment 6 is further provided with a hem or piping 52 extending completely around the periphery of fabric piece 8. Pocket openings 30, 32 and 50 are also hemmed or piped.

Garment 6 also has fabric straps 54, 56, 58 and 60 on the inside surface of garment 6, extending from upper edge 12 to lower edge 18 to enhance integrity of garment 6, matable hook and pile 38 and 42 being affixed at the upper and lower ends, respectively, of strap 60 and matable hook and pile pads 40 and 44 being affixed at the upper and lower ends, respectively, of strap 58.

To increase flexibility to accommodate various hip shapes and sizes, garment 6 may be provided on its inner side with generally triangular elastic inserts 62 and 64 (shown only in FIG. 2) extending from the bottom edge of hem 52 to the top edge of hem 52. Insert is 62 stitched to the edge of strap 58 remote from centerline 10 and insert 64 is stitched to the edge of strap 60 remote from centerline 10. Insert 2 is also stitched to the edge of pocket 28 adjacent to centerline 10 and insert 64 is also stitched to the edge of pocket 26 adjacent to centerline 10.

FIG. 3 shows garment 6 tied around the waist of a wearer, as viewed from the front. The wearer is left-handed, so opening 32 pocket 28 is accessible to the right hand of the wearer.

Garment 6 can be used for other sports than tennis, such as paddle tennis, and furthermore, at the wearer's option, is wearable with centerline 10 in front of or behind the wearer.

It is apparent that the invention attains the foregoing stated objects and others.

The illustrated details are exemplary only except as those details may be included in the appended claims.

I claim:

1. A sport garment for women, said garment having an outer side and an inner side and comprising a fabric piece having a maximum dimension perpendicular to a centerline, an upper edge extending both ways from said center line from a first end of said garment to a second end of said garment, a lower edge including a curved central portion defining a central garment portion symmetrical with respect to said centerline and having a center of curvature above said lower edge, and first and second end portions extending from said central portion to said first and second garment ends and defining first and second garment end portions, respectively, first and second pockets on said central garment portion on the outer side of said garment and symmetrical with respect to said centerline and spaced therefrom, each said pocket having an opening generally facing said upper edge, said garment being wearable with said end portions releasably joined to each other about a wearer's waist with said inner side confronting the wearer's body with said central portion on that hip of the wearer selected by the wearer and with one of said pockets on the front of the wearer's body and accessible to that hand of the wearer selected by the wearer, said opening of each said pocket being oriented diagonally upward from the end thereof adjacent said centerline to the end thereof remote from said centerline.

2. A garment according to claim 1 wherein said piece of fabric and said pockets are of open mesh material with give.

3. A garment according to claim 1 wherein each said pocket is of sufficient size to contain a plurality of tennis balls.

4. A garment according to claim 1 wherein the ends of the openings of said pockets remote from said centerline are at said upper edge and the ends of said openings adjacent said centerline are spaced from said upper edge and from said lower edge.

5. A garment according to claim 1 wherein said end portions are releasably joinable to each other by tying.

6. A garment according to claim 1 wherein said end portions are provided with matable hook and pile pads, one on the inner side of said garment and the other on the outer side of said garment, for releasably joining said end portions together.

7. A garment according to claim 1 further comprising a hook pad on the outer side of said garment for releasably holding a towel.

8. A garment according to claim 1 further comprising an auxiliary pocket on the inner side of said garment, having an upwardly facing opening traversing said centerline for holding money, credit cards, keys, or the like.

9. A garment according to claim 8 wherein said opening of said auxiliary pocket is located along said upper edge.

10. A garment according to claim 1 further comprising first and second straps each extending from said lower edge to said upper edge, said straps being equidistant from said centerline and said first strap being between said centerline and said first pocket and said second strap being between said centerline and said second pocket.

11. A garment according to claim 10 further comprising a hem extending along said lower edge of said fabric piece and first and second generally triangular elastic inserts on said inner side, said first insert being stitched to said first strap and to the edge of said first pocket adjacent to said centerline and said second insert being stitched to said second strap and to the edge of said second pocket adjacent to said centerline.

* * * * *